US005957781A

United States Patent [19]

Kelly

[11] Patent Number: 5,957,781

[45] Date of Patent: Sep. 28, 1999

[54] TETHERED-BALL TRAINING DEVICE

[76] Inventor: Patrick J. Kelly, 11843 S. Ridgewood Cir., Houston, Tex. 77071

[21] Appl. No.: 08/788,025

[22] Filed: Jan. 24, 1997

[51] Int. Cl.[6] ..... A63B 71/02

[52] U.S. Cl. ..... 473/140; 473/142; 473/426; 473/430

[58] Field of Search ..... 473/426, 424, 473/138, 140, 142, 425, 431, 143, 430–459, 490, 115, 120; 280/806; 242/374

[56] References Cited

U.S. PATENT DOCUMENTS

| | | | |
|---|---|---|---|
| 1,554,409 | 9/1925 | Coffee | 473/426 |
| 3,168,212 | 2/1965 | Davis | 473/423 |
| 3,442,510 | 5/1969 | Sorensen . | |
| 3,596,849 | 8/1971 | Tamarin . | |
| 3,716,235 | 2/1973 | Yerkie . | |
| 3,815,922 | 6/1974 | Brainard . | |
| 3,897,950 | 8/1975 | Keller . | |
| 3,966,205 | 6/1976 | Schain . | |
| 4,022,471 | 5/1977 | Keller . | |
| 4,027,880 | 6/1977 | Hadtke . | |
| 4,106,165 | 8/1978 | Clowers . | |
| 4,216,960 | 8/1980 | Nicholls | 473/30 |
| 4,372,561 | 2/1983 | Morgan . | |
| 4,429,880 | 2/1984 | Chen . | |
| 4,647,042 | 3/1987 | Bruce . | |
| 4,658,465 | 4/1987 | Keane . | |
| 4,660,835 | 4/1987 | Locurto . | |
| 4,674,744 | 6/1987 | Walsh . | |
| 4,735,416 | 4/1988 | Yamanouchi . | |
| 4,842,108 | 6/1989 | Anderson . | |
| 4,881,742 | 11/1989 | Hargreave . | |
| 4,948,150 | 8/1990 | Daly . | |
| 4,966,367 | 10/1990 | Oyarzabal . | |
| 4,971,326 | 11/1990 | Montone . | |
| 4,991,840 | 2/1991 | Patton | 473/426 |
| 5,035,432 | 7/1991 | Lew . | |
| 5,040,791 | 8/1991 | Ratajac . | |
| 5,060,946 | 10/1991 | Taylor . | |
| 5,178,393 | 1/1993 | Denneson . | |
| 5,255,768 | 10/1993 | Kasper . | |
| 5,499,812 | 3/1996 | Staka . | |
| 5,558,370 | 9/1996 | Behr | 280/806 |

*Primary Examiner*—Jeanette Chapman
*Assistant Examiner*—Stephen Blau
*Attorney, Agent, or Firm*—Jenkens & Gilchrist, A Professional Corporation

[57] ABSTRACT

A tethered-ball training device used for repetitive training exercises in a variety of sports. The tethered-ball trainer has a ball support means, a retraction means, and a ball. The retraction means is mounted on the support and the tether connects the retraction means to the ball. The retraction means, or tether-rewinding device, allows the tether to feed-out when a force is applied to the ball and provides for a controlled retraction when the force is removed. In alternate embodiments, the retraction means is a spring-wound cord reel and either one or more may be used. Various embodiments include one or multiple-tether devices, a sensor for determining the boundaries of ball travel and speed, completely collapsible support means, and length adjustment means for the support means.

15 Claims, 6 Drawing Sheets

TETHERED-BALL TRAINING DEVICE

BACKGROUND OF THE INVENTION

1. Field of the Invention

This invention relates to a tethered-ball training device that can be used for repetitive training exercises in a variety of ball sports.

2. Description of the Prior Art

In sports, the player is greatly benefitted by repetitive training of the particular motions required in the sport. With ball sports, however, repetitive exercises are hampered by the requirement for retrieving the ball after each execution of a particular exercise. There are several means of coping with ball retrieval, the most simple being to confine the ball in a small enclosure or with the aid of a backboard of some sort. For example, batters can bat in a small cage, and tennis serves can be practiced against a wall. However, even this method requires the trainee to spend some time retrieving balls. Complicated automatic ball retrieval and projectile systems, such as might be found in a batting cage, are available, but these devices tend to be large and expensive and hence not readily accessible for general use.

Another option is to tether the ball in some fashion so that its range of motion is restricted. The use of elastic tethers ensures that the ball will eventually return to rest in the starting position, albeit with considerable rebound action. Tethered-ball training devices can be simple, portable and relatively inexpensive.

A very simple tethered-ball device is described in U.S. Pat. No. 4,948,150. The ball hangs via an elastic cord from an inverted-L-shaped support means. A horizontal surface at the tether point coupled to a flexible vertical rod acts to dampen the kinetic energy imparted by striking the ball. The horizontal surface also functions as a rebound surface and prevents the elastic cord and ball from wrapping around the horizontal support means. The entire device is attached to a net pole or a wall at a fixed height.

A similar example is described in U.S. Pat. No. 3,716,235. The ball hangs from an inverted-U-shaped support means between the two vertical poles. The ball is tethered via an elastic cord and the tether is pivotally mounted to the horizontal pole so that when the ball is struck, the ball and tether freely rotate around the horizontal pole, rather than wrapping around it. The vertical poles are telescoping, allowing the height of the ball to be varied. However, since the device is mounted to a wall or ceiling, adjusting the height of the ball would require a ladder.

Both of these devices are mounted to an existing surface, such as a wall, ceiling, net pole or net. Thus, these devices cannot be used in places where no readily available attachment surface is available. There are, however, a number of free-standing tethered-ball training tools, such as are described in U.S. Pat. Nos. 5,062,946 and 4,647,042. In general, these devices consist of a tethered-ball attached to an inverted-L-shaped support means that stands on the floor via a large base. No means of preventing the ball and tether from wrapping around the poles is provided in U.S. Pat. No. 4,647,042, but in U.S. Pat. No. 5,062,946, the tether is allowed to rotate freely about the horizontal pole by virtue of a pivotal mounting system. Both systems provide for adjusting the height of the ball by adjusting the length of the vertical pole.

In all of these systems, the ball is tethered via a flexible cord, generally made of an elastic material. Thus, all of the devices suffer from excessive rebound reaction of the ball when forcibly struck. There is considerable risk that the ball may rebound and strike the player. Additionally, it may take considerable time for the ball to come to rest, as it will likely rebound several times before stopping.

The use of a vertical elastic tether allows the ball to move vertically and horizontally within the limits of the tether. Although the tether itself may be pivotally mounted to the horizontal support means and thus the ball is free to rotate around the horizontal bar, the ball could also wrap around the vertical support or strike the vertical support and rebound to strike the player unless the tether is sufficiently short.

The problem of too much horizontal mobility has been addressed in U.S. Pat. No. 4,881,742 in an interesting way. Instead of employing a flexible cord as a tether, this device uses a semi-rigid tether pivotally connected to the horizontal pole. Because the tether is semi-rigid, the ball is generally limited in motion to a vertical plane. Thus, sideways movement of the ball is restricted, increasing the safety of the device. However, the use of a semi-rigid tether interferes with the player freely striking the ball, especially in a downward direction, and thus presents its own hazards.

Other rigid tether devices have been described. U.S. Pat. No. 5,499,812 describes a cam arm apparatus wherein the ball is attached to a horizontal rod which rotates about a vertical support rod. Thus, the ball is only free to rotate in a horizontal plane. The cam arm operates to ensure that the ball returns to its original position after being struck. This device is disadvantageous in that the ball cannot be struck in an upward or downward direction. Further, the rigid arm presents some risk to the player who may strike it accidentally. Additionally, the device is heavy, complicated and expensive.

One of the problems with all vertically tethered devices is that the tether itself interferes with a downward strike of the ball. Downward strikes are important in many sports. For example, the spike and the serve in volleyball both require a downward stroke, as does the serve of tennis. Thus, vertically tethered devices are limited in this respect. One means of allowing the player to practice a downward stroke is to support the ball from two points in a horizontal plane. This idea was employed in U.S. Pat. No. 3,897,950. The device disclosed therein employs two horizontal rods ending in soft cups that hold the ball. The ball can be freely struck in a downward direction, causing the poles to move aside and allow the ball to travel freely away from the player. The player must reload the device for the next stroke however, because the ball is not tethered. Further, the player is still at risk for striking the rigid horizontal poles or cups.

A two point attachment, tethered-ball system has also been devised. U.S. Pat. No. 4,372,561 describes a ball supported by two horizontal elastic tethers. The tethers are mounted between two vertical poles that are attached to a net or other surface. Because the ball is attached in two places, it cannot wrap around either pole. However, in allowing for complete freedom of vertical movement, the ball has been restricted horizontally. Thus, the player receives no feedback about his horizontal aiming ability. Further, the device cannot be used where an attachment surface is lacking, for example, in many outdoor locations.

Therefore, what is needed in the art is a tethered-ball training device that provides maximum freedom in the horizontal and vertical planes, yet prevents the ball and tether from becoming entangled in the support means. It would also be advantageous to have a tethering means that does not allow the ball to forcefully rebound towards the player or otherwise present a hazard to the player. Likewise, the ball should not take a long time to come to rest in its starting position. None of the existing tethered-ball devices allow a player to know how well the ball has been directed by his strike, since the motion of the ball is necessarily restricted by the tether. The ideal device would provide feedback to the player as to whether a ball has been directed in or out of bounds and the speed of ball travel. The ideal device would also be freestanding, fully portable, lightweight and inexpensive.

These and other advantages of the present invention will become apparent from the following detailed description.

SUMMARY OF THE INVENTION

The invention is a ball training device that has a tethered-ball attached to a support. Unlike existing trainers, however, the ball is not tethered with an elasticized cord, but rather is tethered via a cord that can be played out and rewound at a controlled speed by a tether-rewinding device or retraction means.

Generally, the invention is a tethered-ball training device having a support, at least one tether-rewinding device mounted on the support and connected to at least one tether, and a ball attached to the tether and being suspended from the support when at rest. The support may include a base to allow the device to be free-standing, although the device may be modified to attach to a variety of surfaces such as the wall, floor, net or existing supports. The tether-rewinding device allows the feed-out of the tether when a force is applied to the ball and the controlled retraction of the tether when the ball has reached the end of the tether. Suitable tether-rewinding devices may be springwound, weight driven or motorized.

One embodiment of the tethered-ball training device has a U-shaped support with a first vertical pole, a second vertical pole, and a horizontal pole connecting the first vertical pole and the second vertical pole. It has a base with a first leg and a second leg. The first vertical pole is perpendicularly connected to the first leg and the second vertical pole is perpendicularly connected to the second leg. The device includes a first spring-wound cord reel with a first tether that is mounted to the first vertical pole and a second spring-wound cord reel with a second tether that is mounted to the second vertical pole. A ball is attached to both the first and second tethers, thus being suspended between the first and second vertical poles.

In one modification of the two tether device, the vertical poles are not contiguous, but comprised of two parts removably connected together. Thus, an inverted-U-shaped portion can be detached from the vertical poles and reattached in a perpendicular orientation, thus forming a C-shaped portion. In this way, the device is converted from a two point horizontal attachment system used for generally vertical strikes to a two point vertical attachment system that can be used for generally horizontal strikes. This feature maximizes both the vertical and horizontal mobility of the ball, while the two point attachment system prevents the tethered ball from wrapping around the support.

Other embodiments of the two-tether device include single-reel variations. For example, a tethered-ball training device has a U-shaped support with first and second vertical poles and a horizontal pole connecting the first and second vertical poles, and forming first and second corners. It also has a base with first and second legs, wherein the first vertical pole is perpendicularly connected to the first leg and the second vertical pole is perpendicularly connected to the second leg. First and third guide pulleys are mounted on the first and second comers, respectively. Second and fourth guide pulleys are mounted on the first and second vertical poles, respectively. A spring-wound cord reel with first and second tethers is mounted on the horizontal pole. The first tether is threaded through the first and third guide pulleys to a ball, and the second tether is threaded through the second and fourth guide pulleys to the ball, such that said ball is suspended between the first and second vertical poles.

Likewise, in another two-tether, single-reel embodiment, the tethered-ball training device has a U-shaped support with a first vertical pole, a second vertical pole, and a horizontal pole connecting the first vertical pole and the second vertical pole. The device has a U-shaped base with a first leg, a second leg, and a cross bar connecting the first leg and the second leg and forming a first and second comer. The first vertical pole is perpendicularly connected to the first leg and forms a third corner, and the second vertical pole is perpendicularly connected to the second leg and forms a fourth comer. First, second, third, and fourth guide pulleys are mounted at the first, second, third, and fourth comers, respectively. Fifth and sixth guide pulleys are mounted on the first and second vertical poles, respectively. The spring-wound cord reel, with the first and second tethers, is mounted to the cross bar. The first tether is threaded through the first, third, and fifth guide pulleys to the ball, and the second tether is threaded through the second, fourth, and sixth guide pulleys to the ball, so that the ball is suspended between the first and second vertical poles.

The tethered-ball training devices described herein may also have a first brace connecting the first vertical pole and first leg, as well as a second brace connecting the second vertical pole and second leg. Likewise, it may be desired to brace the first and second vertical poles against the horizontal pole. The braces provide for increased stability of the support.

In yet another embodiment, the device may comprise a support and a single-tether ball that can be rewound with a spring-wound cord reel. For ground ball sports, the support is simple and may include a spike that can be driven into the ground for stability or a base that is sufficiently stable to keep the device stationary while the ball is kicked and the spring-wound cord reel is played out.

Other variations on the device include the addition of a sensor, digital data processor or computer, and output device to indicate speed and trajectory of the ball; a telescoping or collapsible support; height adjustment means for the support or ball; and a speed sensitive lock on the spring-wound cord reel.

DESCRIPTION OF THE INVENTION

The invention is a ball training device that has a tethered-ball attached to a support. Unlike existing trainers, the ball is not tethered with an elasticized cord, but rather is tethered via a cord that can be played out and rewound at a controlled speed by a tether-rewinding device. The device may include a sensor and means of calculating and communicating the balls trajectory and speed.

Figure 1:
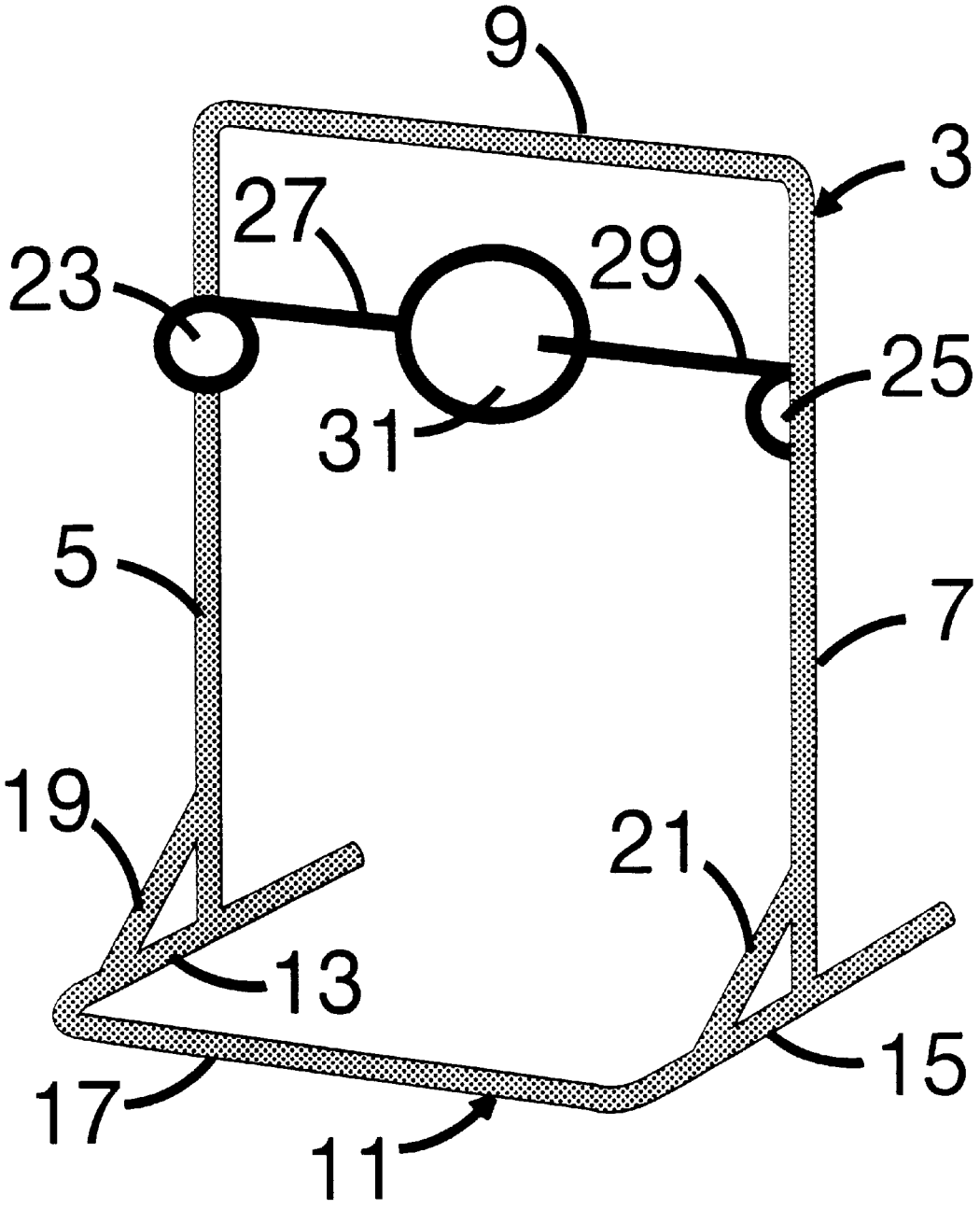
FIG. 1 is a perspective view of a double spring-wound cord reel tethered-ball trainer.
Figure 2:
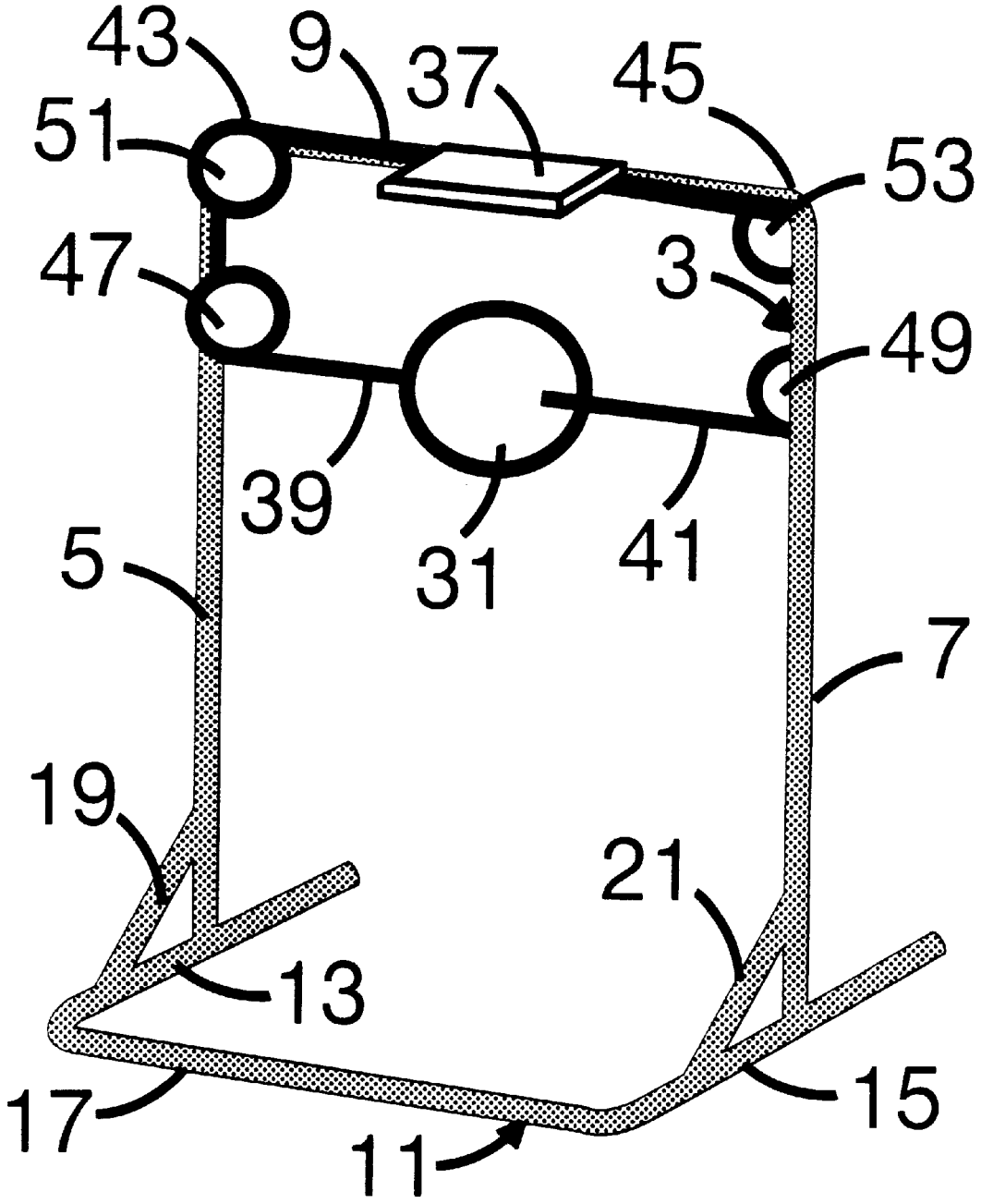
FIG. 2 is perspective view of a single spring-wound cord reel tethered-ball trainer where the cord reel is mounted overhead and has two tethers.
Figure 3:
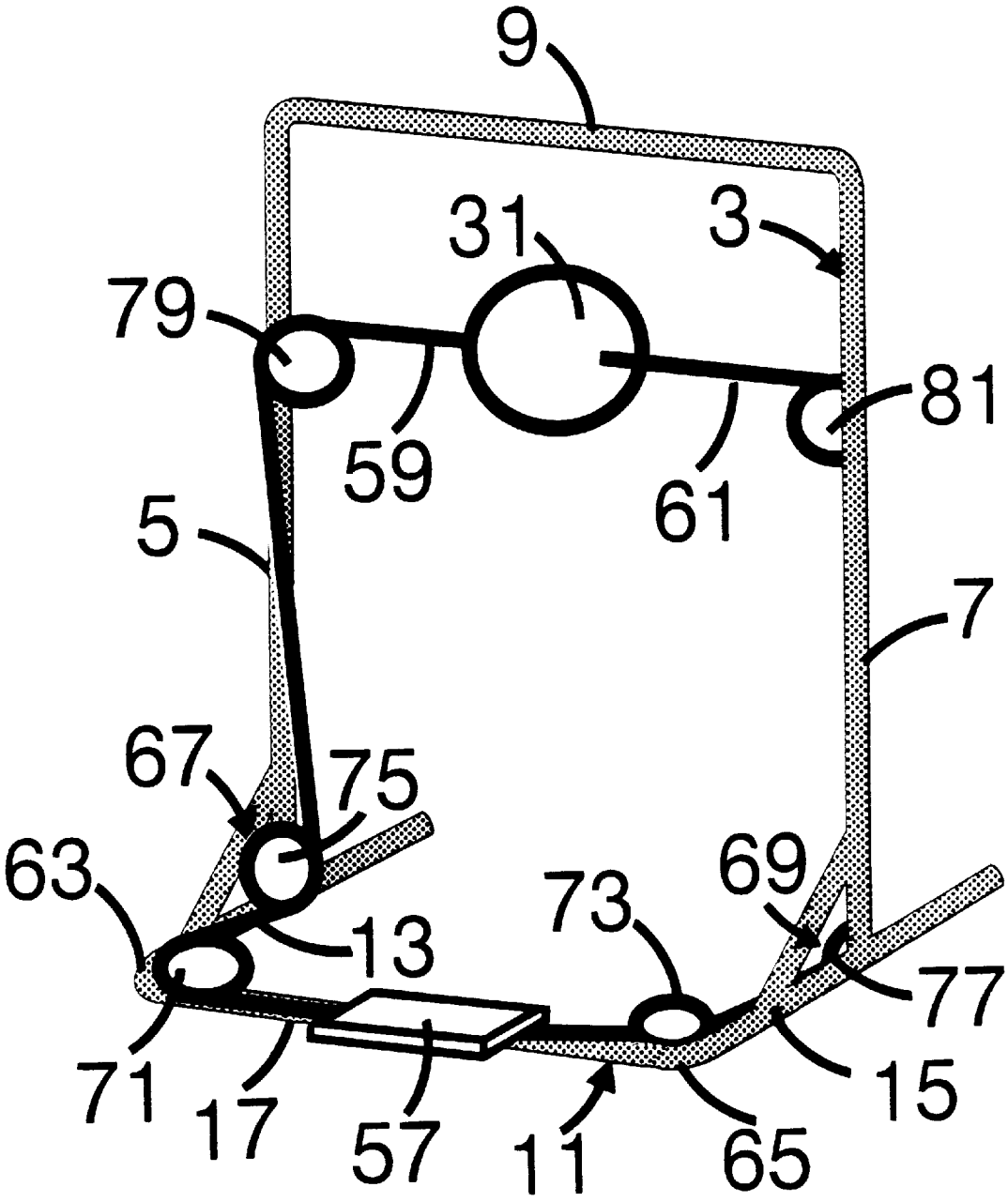
FIG. 3 is perspective view of a single spring-wound cord reel tethered-ball trainer where the cord reel is mounted to the base and has two tethers.

FIGS. 1, 2, and 3 show three embodiments of the invention where spring-wound cord reel(s) is (are) placed at various locations on the tethered-ball training device. The basic frame for these embodiments, however, is the same and is described as follows: The tethered-ball trainer 1, 35, 55 has a substantially U-shaped support that consists of three parts: a first vertical pole 5, a second vertical pole 7, and a horizontal pole 9 connecting the two. The tethered-ball trainer 1, 35, 55 also has a base that consists of at least a first leg 13 and a second leg 15. It may also optionally have a cross bar 17 and thus present a substantially U-shaped base 11. For increased stability, the tethered-ball trainer 1, 35, 55 may optionally have a first brace 19 and a second brace 21. The first brace 19 is coupled to the first vertical pole 5 and the first leg 13. The second brace 21 is coupled to the second vertical pole 7 and second leg 15.

The spring reel and tether system of FIG. 1 is as follows: a first spring reel 23 is coupled on the first vertical pole 5 and has a first tether 27. A second spring reel 25 is coupled on the second vertical pole 7 and has a second tether 29. The first and second tethers 27, 29 are coupled to the ball 31, thus suspending it between the first and second vertical poles 5, 7.

The spring reel, pulley and tether system of FIG. 2 is as follows: A single spring reel 37 is coupled on the horizontal pole 9 and has a first tether 39 and a second tether 41 coupled to it. First and second guide pulleys 51, 53 are coupled at a first and second corner 43, 45 created by the intersection of the first and second vertical poles 5, 7 with the horizontal pole 9. Third and fourth guide pulleys 47, 49 are coupled on the first and second vertical poles 5, 7. The first tether 39 passes from the spring reel 37 through the first and third guide pulley 51, 47 to the ball 31. The second tether 41 passes from the spring reel 37 through the second and fourth guide pulley 53, 49 to the ball 31. Again, the result is to suspend the ball between the first and second vertical poles 5, 7.

The spring reel, pulley and tether system of FIG. 3 is as follows: A single spring reel 57 is coupled on the cross bar 17 and has a first tether 59 and a second tether 61 coupled to it. First and second comers 63, 65 are formed by the intersection of the cross bar 17 and the first and second legs 13, 15. Third and fourth corners 67, 69 are formed by the intersection of the first and second vertical poles 5, 7 with the first and second legs 13, 15. First, second, third, and fourth guide pulleys 71, 73, 75, 77 are coupled at the first, second, third, and fourth comers 63, 65, 67, 69. Fifth and sixth guide pulleys 79, 81 are coupled on the first and second vertical poles 5, 7. The first tether 59 passes from the spring reel 57 through the first, third, and fifth guide pulley 71, 75, 79 to the ball 31. The second tether 61 passes from the spring reel 57 through the second, fourth, and sixth guide pulleys 73, 77, 81 to the ball 31 so that the ball is suspended between the first and second vertical poles 5, 7.

Figure 4:
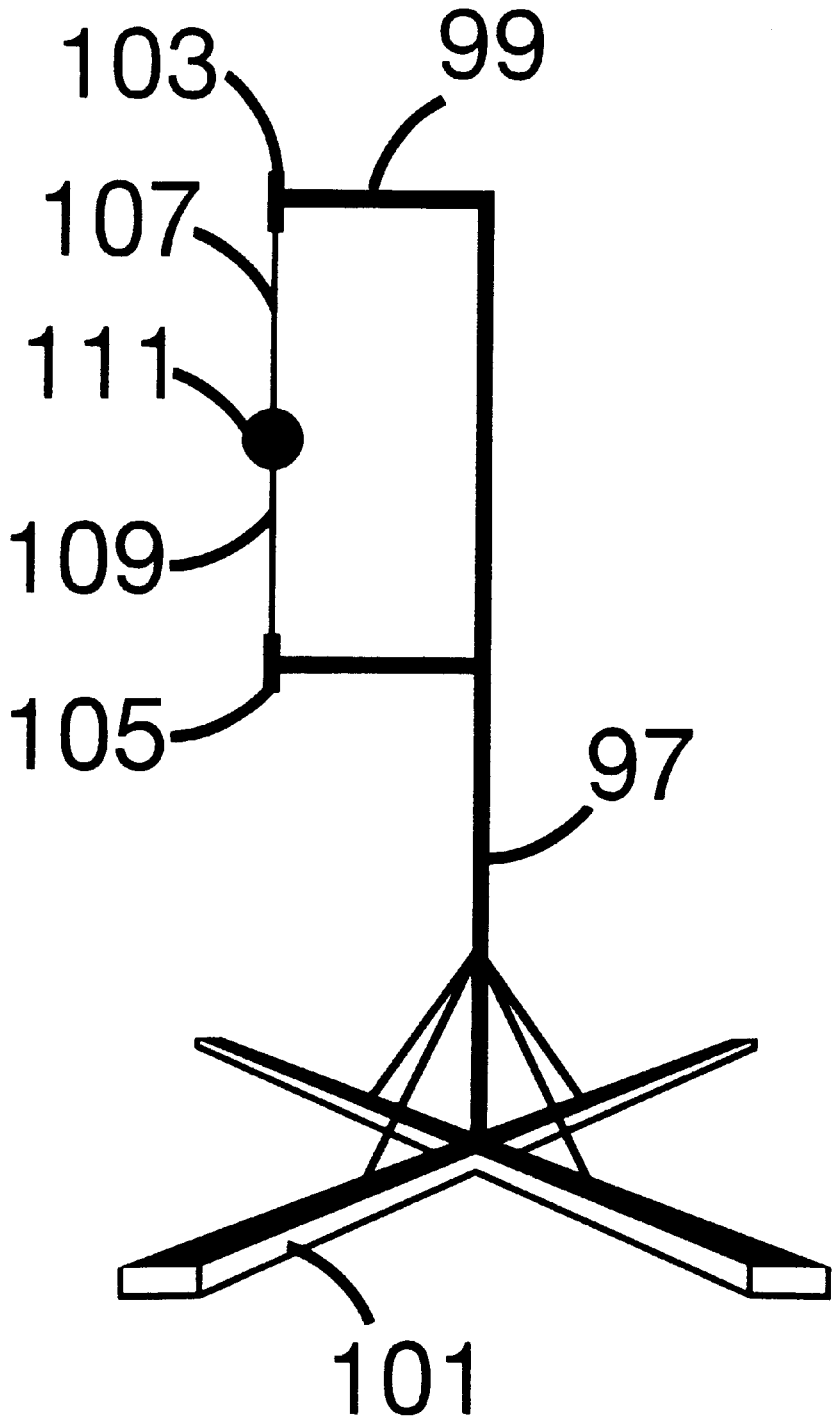
FIG. 4 is a perspective view of a double spring-wound cord reel vertically tethered-ball trainer.

FIG. 4 depicts a variation on the two spring reel and tether device of the present invention where the tethers support the ball in the vertical plane, thus allowing a generally horizontal strike of the ball. This variation might be useful in a sport such as baseball where a generally horizontal swing of the bat toward the ball is employed. The tethered-ball trainer 95 comprises a support that has a vertical pole 97, a base 101, and a C-shaped portion 99 to which are attached first and second spring-wound cord reels 103, 105. The C-shaped portion 99 could be detachable, allowing the C-shaped portion 99 to be reattached in a perpendicular orientation creating a U-shaped portion (not shown) and reorienting the tethers. The spring reels 103, 105 connect to first and second tethers 107, 109 that suspend the ball 111 between the spring reels 103, 105.

Figure 5:
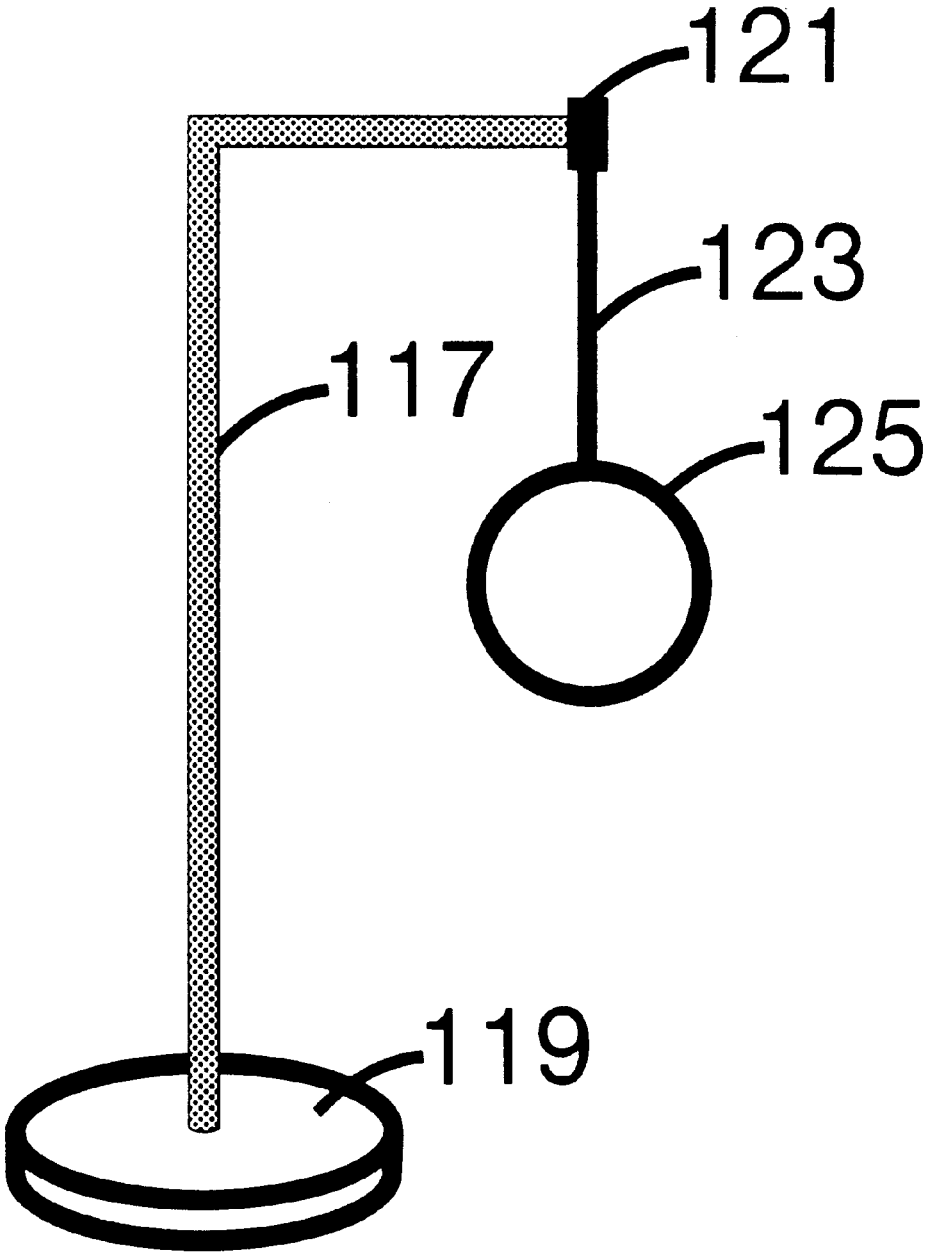
FIG. 5 is a perspective view of a single spring-wound cord reel tethered-ball trainer with a single tether.

FIG. 5 depicts a single spring reel and tether device where the tether supports the ball in a vertical plane. This variation might be useful in a sport such as baseball or tennis or any sport where a horizontal stroke is to be practiced. The tethered-ball trainer 115 comprises an inverted-L-shaped support 117, a base 119, and a single spring-wound cord reel 121 coupled on the support 117. The spring reel 121 is coupled to the ball 125 via a single tether 123.

Figure 6:
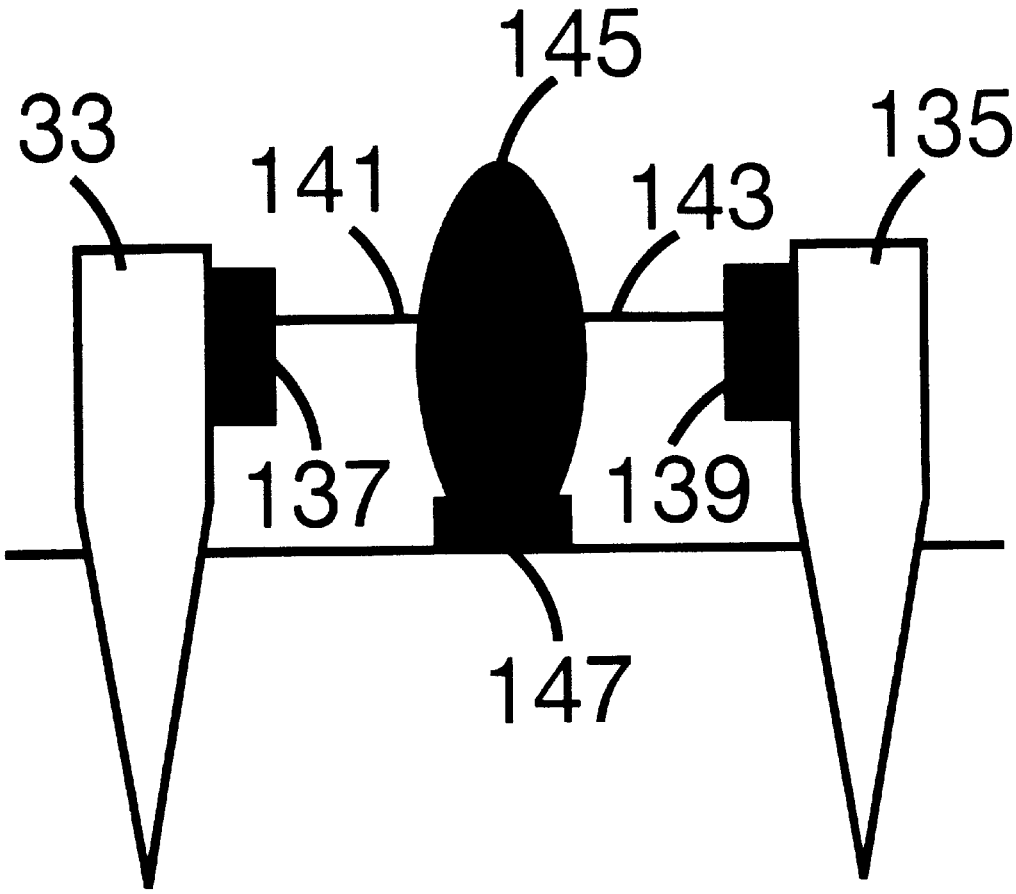
FIG. 6 is an end view of a double spring-wound cord reel tethered-ball trainer used for ground sports.

FIG. 6 depicts a two spring reel and tether device designed to be used with ground-ball sports such as football, soccer, croquet, golf, etc. The tethered-ball trainer 131 comprises a first and second spike 133, 135 used to anchor the device and support the first and second spring-wound cord reels 137, 139. The ball 145 is tethered via a pair of tethers 141, 143 to the pair of spring reels 137, 139. A tee 147 is optional depending on the sport.

In operation the ball is struck in a manner appropriate for the sport. The orientation of the tethers varies with the type of stroke desired and the device can allow different tether orientations. Thus, the horizontal and vertical mobility of the ball and player is maximized. For example, in volleyball the ball is struck in a generally downward direction for practicing spikes. Therefore, the ball is tethered horizontally.

The force imparted to the ball causes the tether to unwind as the ball travels away from the support. At the end of the tether the ball will recoil with some force and the spring-wound cord reel will cause the ball to rewind at a controlled speed. The ball will then come quickly to rest in its starting position without any pendulum action. The use of the spring-wound cord reel or any other tether-rewinding device prevents excessive and hazardous rebound reaction of the ball and also ensures that the ball returns to its starting position fairly quickly.

Suitable tether-rewinding (or cord-rewinding) means are well known and are found on devices such as vacuum cleaners and lawn mowers. Tether-rewinding devices may be spring-wound, counter weight driven or motorized. By way of example, a suitable tether-rewinding mechanism is found is U.S. Pat. No. 3,596,849 (incorporated herein by reference), which describes a spring-wound rotatable cord reel having a fixed magnetized ratchet and pawl of magnetically attractable material pivotally secured to and rotatable with the reel. The pawl lockingly engages the ratchet when the reel rotates in the cord-rewinding direction at a relatively slow rate. However, when the reel rotates at a faster rate, the pawl orbits around the ratchet.

With this tether-rewinding device, the cord can be extended and gently released to lock it in an extended position. When the cord is rapidly released, however, such as when the ball rebounds at the end of the tether after being forcefully struck, the cord completely retracts within the reel. By using such a speed-sensitive locking means, it is possible to pull the ball towards the user and lock the reel with a slow release, thus allowing the device to be employed in a serving exercise such as with volleyball serves.

It is possible to equip the tethered-ball training device with a sensor or sensors operably coupled to the spring-wound cord reel (or the support, as appropriate for the technology employed). One example of a suitable contact-sensor is the position transducer available from SpaceAge Control, Inc. of California. The position transducer consists of a stainless steel extension cable wound on a threaded drum that is coupled to a potentiometer. The sensor detects the speed of ball travel and communicates this data to a digital data processor or computer. With three sensors, it is also possible to determine the path of ball movement. Therefore, the computer chip or processor can calculate an approximate ball trajectory and provide an indication of whether the ball would have landed in or out of bounds and indicate the speed of the ball. The processor provides this information to an output device to indicate to the success of the player's aim and/or the speed of the ball's travel. Digital processors are generally known and commonly used for processing input signals. Output devices are also well known and include visual displays, lights, sounds or any other means of communicating a successful strike.

Mathematical formulae for calculating the trajectory of a ball with respect to court boundaries are provided in U.S. Pat. No. 3,966,205 (incorporated herein by reference). Further, it may be desirable to provide the user with a number of starting position options. The user may thus simulate strikes from the center of the court or playing field, the far left, middle left, far right and middle right positions, for example. With the use of a digital processor, it is easily possible for the user to select a starting position and the mathematical formulae are adjusted accordingly.

Yet another means of providing position information would be to provide the ball with double tethers on each side of the ball. Position sensors on each cable would provide information about the rate of travel of each tether, thus providing an accurate measurement of the direction and speed of the ball. The difference in measured values between the right and left sensors would provide right and left travel information and, likewise, the difference between the top and bottom sensors would indicate the height of the ball's travel.

Sophisticated sensor technology includes non-contact sensors such as laser sensors, ultrasound sensors, and contact sensors, such as position transducers, pressure or strain gauges. However, it is also possible to employ a low-tech solution to the problem of trajectory feedback. It is possible to equip the tethered-ball training device with simple side surfaces (suspended from the vertical poles of the device) that approximate an out of bounds condition. The side surface could be stationary or could be pivotable and equipped with a spring bias its return to the starting position. In this case, when the ball strikes a side surface it would be deflected from its original position, thus signaling the user that the ball was aimed too far to one side of the playing field or court. Passing underneath a side surface would also indicate an out of bounds condition. The side surface could be a solid surface, a bar or a bar from which a lightweight net is suspended. Likewise, a similar marker system can be placed at the back of the device (near the end of the ball's trajectory) to indicate the far boundary. While this technique provides a crude estimate of the boundary conditions, it has the benefit of being fairly inexpensive. Furthermore, in combination with a single position transducer, as above, the user has information about the speed of the ball and an estimate of his aiming ability at very low cost. Speed and trajectory information are invaluable for the training of the serious player.

The number of tethers employed in the device is variable, depending on its application. However, multiple tether devices have the advantage that they will not allow the ball to wrap around the support. Nonetheless, single tether devices may be desirable for certain sports where less flexibility is necessary, such as in golf where the ball is always struck in the same way. For a single-tethered-ball golf training device, the support means may be a simple vertical support that holds the ball on a tee and a tether-rewinding device such as a spring-wound cord reel. The support may include a spike that can be driven into the ground or a base meant to stand on a floor.

Single or multiple-tether devices may also be used for soccer, football, croquet, golf and similar ground sports with some modification of the support means. In soccer, the ball sits on the ground, rather than on a tee as in golf and football. The support is therefore simple and may include a spike that can be driven into the ground for stability or a base that is sufficiently stable to keep the device stationary while the ball is kicked and the spring-wound cord reel is played out.

Where the support is a simple, lightweight structure and the ball is heavy or driven with strong force, it may be necessary to anchor the support to prevent its motion when the ball is struck. One means of anchoring the support is to include suction cups on the bottom to firmly attach the support and reel to the floor. Another means allows the support to be anchored using existing net pole anchoring holes in a gym floor. For outdoor applications, it is possible to drive spikes attached to the support into the ground. Alternately, the support can be firmly anchored through weight or by frictional means.

It may also be desirable to have a tethered-ball training device of variable height. This can be accomplished in a variety of ways by adjusting the length of the vertical poles of the support means. Another desirable feature may be to manufacture the device in such a way that the support means and base are completely collapsible. Thus the device may be folded up or disassembled for easy transport and storage.

The proportions of the various parts of the tethered-ball trainer depend on the sport that the trainer is designed for. For example, the height of the support will be higher for a trainer intended for use with volleyball than one intended to train a football field kicker. The ideal proportions can be determined empirically for each sport. Alternatively, the various poles of the device may be telescoping to allow the user to vary the height or length of a given portion and maximize the flexibility of the device. Telescoping poles can also increase the portability of the device.

The trainer may be equipped with a ball that has been specially adapted to connect to the tethers via, for example, eye hooks or other connectors. Alternatively, a harness that can hold balls of a variety of sizes might be provided. The harness might have adjustable Velcro tabs or might be made of netting.

Many other variations and modifications may be made in the devices herein described, by those having experience in this art, without departing from the concept of the present invention. Accordingly, it should be clearly understood that the devices described in the foregoing description are illustrative only, and not intended as a limitation on the scope of the invention.

I claim:

1. A tethered-ball training device comprising:

a) a support;

b) first and second tether-rewinding devices coupled to said support and coupled to first and second tethers, wherein the tether-rewinding devices allow the feed-out of the tethers when a force is applied thereto and the controlled retraction of the tethers when the force is removed; and c) a ball coupled to the first and second tethers, wherein said support further comprises:

d) a U-shaped support having a first vertical pole, a second vertical pole and a horizontal pole connecting the first vertical pole and the second vertical pole;

e) a base having a first leg and a second leg, wherein the first vertical pole is coupled to the first leg and the second vertical pole is coupled to the second leg.

2. The tethered-ball training device of claim 1, wherein the tether-rewinding device is a spring-wound rotatable cord reel.

3. The tethered-ball training device of claim 2, wherein the spring-wound rotatable cord reel further comprises a speed-sensitive lock.

4. The tethered-ball training device of claim 1, wherein the support is collapsible.

5. The tethered-ball training device of claim 1, wherein the support is telescoping.

6. The tethered-ball training device of claim 2, further comprising;

a) a sensor operably coupled to the tethered-ball training device;

b) a digital processor operably coupled to the sensor for calculating the trajectory and speed of the ball; and c) an output device operably coupled to the digital processor for communicating the trajectory and speed of the ball.

7. A tethered-ball training device comprising:

a) a U-shaped support having a first vertical pole, a second vertical pole and a horizontal pole connecting the first vertical pole and the second vertical pole;

b) a base having a first leg and a second leg, wherein the first vertical pole is coupled to the first leg and the second vertical pole is coupled to the second leg;

c) a first tether-rewinding device having a first tether, wherein the first tether-rewinding device is coupled to the first vertical pole;

d) a second tether-rewinding device having a second tether, wherein the second tether-rewinding device is coupled to the second vertical pole; and e) a ball attached to the first tether and the second tether, thus being suspended between the first and second vertical poles.

8. The tethered-ball training device of claim 7, wherein the tether-rewinding device is a spring-wound cord reel.

9. The tethered-ball training device of claim 7, further comprising:

a) a first brace connecting the first vertical pole and the first leg; and b) a second brace connecting the second vertical pole and the second leg.

10. The tethered-ball training device of claim 7, further comprising:

a) a sensor operably coupled to the tethered-ball training device;

b) a digital processor operably coupled to the sensor for calculating the trajectory and speed of the ball; and c) an output device operably coupled to the digital processor for communicating the trajectory and speed of the ball.

11. The tethered-ball training device of claim 7, wherein the first and second vertical poles are of adjustable length.

12. The tethered-ball training device of claim 11, wherein the U-shaped support and base are collapsible.

13. The tethered-ball training device of claim 7, wherein the tether-rewinding devices further comprise a speed-sensitive lock, wherein said tether-rewinding devices allow the feed-out of the tethers when a force is applied thereto and the controlled retraction of the tethers when the force is quickly removed and the speed-sensitive lock allows the tether-rewinding devices to lock in a partially retracted position when the tethers are allowed to slowly retract.

14. The tethered-ball training device of claim 13, wherein the support is collapsible.

15. The tethered-ball training device of claim 13, wherein the support is telescoping.

* * * * *

UNITED STATES PATENT AND TRADEMARK OFFICE

CERTIFICATE OF CORRECTION

PATENT NO. : 5,957,781

DATED : September 28, 1999

INVENTOR(S) : Patrick J. Kelly

It is certified that error appears in the above-identified patent and that said Letters Patent is hereby corrected as shown below:

Col. 5, line 56, delete "comers" and insert --corners--.

Signed and Sealed this

Twenty-third Day of May, 2000

*Attest:*

Q. TODD DICKINSON

*Attesting Officer*

*Director of Patents and Trademarks*